US009631329B2

(12) United States Patent
Fritz et al.

(10) Patent No.: US 9,631,329 B2
(45) Date of Patent: Apr. 25, 2017

(54) FRAME DISTORTION CONTROL

(71) Applicant: Wirtgen GmbH, Windhagen (DE)

(72) Inventors: Matthias Fritz, Linz (DE); Martin Dahm, Gieleroth (DE); Martin Lenz, Grossmaischeid (DE)

(73) Assignee: Wirtgen GmbH (DE)

( * ) Notice: Subject to any disclaimer, the term of this patent is extended or adjusted under 35 U.S.C. 154(b) by 143 days.

(21) Appl. No.: 14/576,382

(22) Filed: Dec. 19, 2014

(65) Prior Publication Data

US 2016/0177519 A1 Jun. 23, 2016

(51) Int. Cl.

| | |
|---|---|
| ***E01C 19/48*** | (2006.01) |
| ***E01C 19/42*** | (2006.01) |
| ***E01C 19/00*** | (2006.01) |
| ***E01C 19/22*** | (2006.01) |

(52) U.S. Cl.

CPC ..... *E01C 19/484* (2013.01); *E01C 19/006* (2013.01); *E01C 19/22* (2013.01); *E01C 19/42* (2013.01); *E01C 19/4853* (2013.01)

(58) Field of Classification Search

CPC ..... E01C 19/006; E02F 3/842; E02F 9/028
USPC ..... 404/84.05, 84.1, 84.5
See application file for complete search history.

(56) References Cited

U.S. PATENT DOCUMENTS

| | | | | |
|---|---|---|---|---|
| 3,423,859 | A | 1/1969 | Swisher, Jr. et al. | |
| 3,637,026 | A | 1/1972 | Snow | |
| 3,709,116 | A * | 1/1973 | Whitbread | E01B 27/02 404/105 |
| 3,749,504 | A | 7/1973 | Smith | |
| 3,779,662 | A | 12/1973 | Smith | |
| 4,029,165 | A | 6/1977 | Miller et al. | |
| 4,139,318 | A | 2/1979 | Jakob et al. | |
| 4,140,420 | A | 2/1979 | Swisher, Jr. et al. | |
| 4,403,889 | A | 9/1983 | Gillotti | |
| 5,009,544 | A * | 4/1991 | Chaize | E01C 19/008 172/4.5 |
| 5,174,385 | A * | 12/1992 | Shinbo | E02F 3/842 172/4.5 |
| 5,941,658 | A | 8/1999 | Dahlinger et al. | |
| 6,082,927 | A | 7/2000 | Dahlinger et al. | |
| 6,916,070 | B2 | 7/2005 | Sehr | |
| 8,068,962 | B2 * | 11/2011 | Colvard | E01C 19/006 404/84.05 |

(Continued)

FOREIGN PATENT DOCUMENTS

| | | | |
|---|---|---|---|
| DE | 19602831 | A1 | 7/1997 |
| DE | 10060903 | A1 | 7/2002 |

(Continued)

OTHER PUBLICATIONS

European Search Report in corresponding European Patent Application No. EP 15 20 1060, dated Apr. 27, 2016, 2 pp. (not prior art).

(Continued)

*Primary Examiner* — Gary Hartmann
(74) *Attorney, Agent, or Firm* — Lucian Wayne Beavers; Patterson Intellectual Property Law, PC

(57) ABSTRACT

A slipform paving machine includes a laser source for generating a laser reference plane. At least two laser receivers are mounted on the machine and intersect the laser reference plane. Inputs from the laser receivers are utilized to control distortion of the frame of the slipform paver machine.

15 Claims, 6 Drawing Sheets

(56) References Cited

U.S. PATENT DOCUMENTS

| | | | | |
|---|---|---|---|---|
| 8,246,270 | B2 | 8/2012 | Berning et al. | |
| 8,672,581 | B2 | 3/2014 | Berning et al. | |
| 8,788,154 | B2 * | 7/2014 | O'Connor | G05D 1/0236 356/141.4 |
| 8,794,868 | B2 * | 8/2014 | Fritz | E01C 19/006 404/84.5 |
| 8,807,867 | B2 | 8/2014 | Berning et al. | |
| 9,279,679 | B2 * | 3/2016 | Kumagai | E01C 19/006 |
| 9,388,538 | B2 * | 7/2016 | Dahm | E01C 19/4886 |
| 9,388,539 | B2 * | 7/2016 | Dahm | E01C 19/4886 |
| 2006/0198700 | A1 * | 9/2006 | Maier | E01C 19/006 404/84.1 |
| 2008/0152428 | A1 | 6/2008 | Berning et al. | |
| 2016/0177517 | A1 * | 6/2016 | Engels | G06T 7/20 404/75 |

FOREIGN PATENT DOCUMENTS

| | | | |
|---|---|---|---|
| DE | 102006062129 | A1 | 7/2008 |
| FR | 2635544 | A1 | 2/1990 |
| FR | 2732373 | A1 | 10/1996 |

OTHER PUBLICATIONS

Leica Rugby 600 Series—brochure, 8 pp. (undated but admitted to be prior art).
Leica Geosystems Machine Control Solutions—brochure, 19 pp. (undated but admitted to be prior art).

* cited by examiner

FRAME DISTORTION CONTROL

BACKGROUND OF THE INVENTION

1. Field of the Invention

The present invention relates generally to height control systems for controlling the height of a construction machine, and more particularly, but not by way of limitation, to such systems for use in slipform paving machines.

2. Description of the Prior Art

In all construction machines which are utilized for preparing a ground surface, such as road milling machines, surface stabilizing machines, ground trimmer machines, or in construction machines for forming structures on a ground surface, such as a slipform paving machine, one important factor is the control of the height of the working implements and thus the grade or height of the ground surface being prepared or the structure being formed.

Such construction machines typically take a reference reading from a string line which has been placed on one or both sides of the intended path of the machine, or in some instances a reference is taken from an existing structure such as a previously graded surface or the like.

When the construction machine takes its height reference from a single string line that has been placed along one side of the path which the construction machine is to follow, the side of the machine adjacent the string line, which may be referred to as a reference side of the machine, has its height controlled with reference to the string line. Then, in order to orient the machine in a desired orientation relative to the ground surface, the opposite side of the machine, which may be referred to as a control side, may be controlled in response to a cross-slope sensor placed on the machine frame. If it is desired that the prepared surface or the formed structure be exactly horizontal, then the cross-slope will be controlled to be zero so that the entire prepared surface or formed structure is horizontal and at the desired elevation with reference to the reference string line.

If it is desired that the prepared surface or formed structure have a cross-slope, for example if a road surface is to be sloped from one side of the road toward the other side of the road, then the control side height may differ from the reference side height, all of which can be determined via the cross-slope sensor placed on the frame.

While controls of the type just described may be perfectly suitable for equipment with very rigid frames such as for example a typical road milling machine, an additional problem is encountered with very wide equipment, such as for example a grade trimming machine or a slipform paving machine. Such equipment may be designed to prepare or pave surfaces having widths as much as 24 feet or even greater. Furthermore, such construction equipment is often constructed such that the machine frame can be varied in width so as to accommodate paving of different widths. Such frames may also be variable in length to accommodate the installation of additional ground working equipment, such as for example the placement of a dowel bar inserter behind a slipform paving machine.

With these relatively wide frames, and particularly with frames which are extendable in width and/or length, a problem may be encountered with the distortion of the machine frame due to its inherent flexibility and the very heavy loads placed on the frame.

Accordingly, improved height control systems for construction equipment frames are needed to address this problem of frame distortion.

SUMMARY OF THE INVENTION

A construction machine apparatus is disclosed including a machine frame having at least two self-propelling ground engaging units. A plurality of height adjustable supports support the construction machine. At least three of these height adjustable supports are arranged to support the machine frame from the ground engaging units. A laser plane source is mounted on the machine frame at a first location and arranged to generate a laser plane. First and second laser sensors are mounted on the construction machine at at least two other locations and arranged to intersect the laser planes to detect a height of the at least two other locations relative to the laser plane. A controller is configured to receive input signals from the first and second laser sensors and to control height adjustment of at least one of the at least two other locations on the construction machine.

In another embodiment a slipform paving apparatus is provided including a machine frame. The machine frame includes a reference side frame member, a control side frame member, and at least one transverse frame member connected to the side frame members. The at least one transverse frame member is adjustable to adjust the frame width between the side frame members. A mold is supported from the machine frame for forming concrete into a molded concrete structure as the apparatus moves forward. A laser plane source is mounted on the frame and arranged to generate a laser plane. First and second laser sensors are mounted on the frame and arranged to intersect the laser plane to detect a height of the frame relative to the laser plane at a location of each laser sensor. At least one of the laser plane source, the first laser sensor and the second laser sensor is mounted on each of the side frame members. At least one reference side ground engaging unit and at least one control side ground engaging unit are provided. Front and rear reference side height adjustable supports support the reference side frame member from the at least one reference side ground engaging unit. Front and rear control side height adjustable supports support the control side frame member from the at least one control side ground engaging unit. A cross-slope sensor is mounted on the machine frame and arranged to detect a cross-slope angle of the machine frame. A controller is configured to receive input signals from the first and second laser sensors and from the cross-slope sensor. The controller is also configured to control height adjustment of at least the front and the rear control side height adjustable supports.

In another embodiment a method is provided of operating a construction machine, the method comprising:

(a) generating a laser reference plane with a laser source supported from a machine frame of the construction machine, such that the laser reference plane is fixed relative to at least one location on the machine frame;

(b) detecting a height relative to the laser reference point of at least two other locations on the construction machine by monitoring signals from at least two laser sensors mounted on the construction machine at the at least two other locations, the at least two laser sensors intersecting the laser plane; and (c) adjusting the height relative to the laser reference plane of at least one of the at least two other locations in response to the heights detected in step (b).

In any of the above embodiments the location of the laser sensors may be on the machine frame so as to detect distortion of the machine frame, and the controller may be configured to control the distortion of the machine frame.

In any of the above embodiments a cross-slope sensor may be mounted on the machine frame and arranged to detect a cross-slope angle of the machine frame. The controller may be further configured to receive input signals from the cross-slope sensor and to control the cross-slope angle of the frame in response to the cross-slope sensor.

In any of the above embodiments the controller may be configured to generate a longitudinal inclination adjustment signal to control a longitudinal inclination of the control side frame member relative to the laser plane.

In any of the above embodiments the control side frame member may be maintained longitudinally parallel to the reference side frame member, or it may be maintained at a desired angle to the reference side frame member.

In any of the above embodiments the controller may be configured such that a cross-slope adjustment signal directs a height adjustment of a rear control side height adjustable support and such that a longitudinal inclination adjustment signal directs a height adjustment of the front control side height adjustable support.

In any of the above embodiments the construction machine may be a slipform paver having an adjustable width. The construction machine may also have an adjustable length.

In any of the above embodiments the laser source may be mounted on one of the side frame members and the first and second laser sensors may be longitudinally spaced on the other of the side frame members.

In any of the above embodiments front and rear string line reference sensors may be mounted on the reference side frame member and configured to detect a height of the front and rear reference side height adjustable supports relative to an external string line. The controller may be configured to receive input signals from the front and rear string line reference sensors, and to control height adjustment of the front and rear reference side height adjustable supports in response to the front and rear string line reference sensors.

In any of the above embodiments the machine frame may be supported from the ground engaging units by at least four height adjustable supports so that a planar shape of the machine frame is over determined, and the controller may be configured to control the distortion of the machine frame by adjusting at least one of the at least four height adjustable supports relative to the others.

In any of the above embodiments the machine frame may include an auxiliary component which is independently supported and which has an articulated connection to the machine frame, and laser sensors may be placed upon the auxiliary component. This allows height of the auxiliary component to be controlled relative to the reference plane defined on the machine frame. A cross-slope and height of the auxiliary component may be controlled.

Numerous objects features and advantages of the present invention will be readily apparent to those skilled in the art upon a reading of the following disclosure when taken in conjunction with the accompanying drawings.

DETAILED DESCRIPTION

Figure 1:
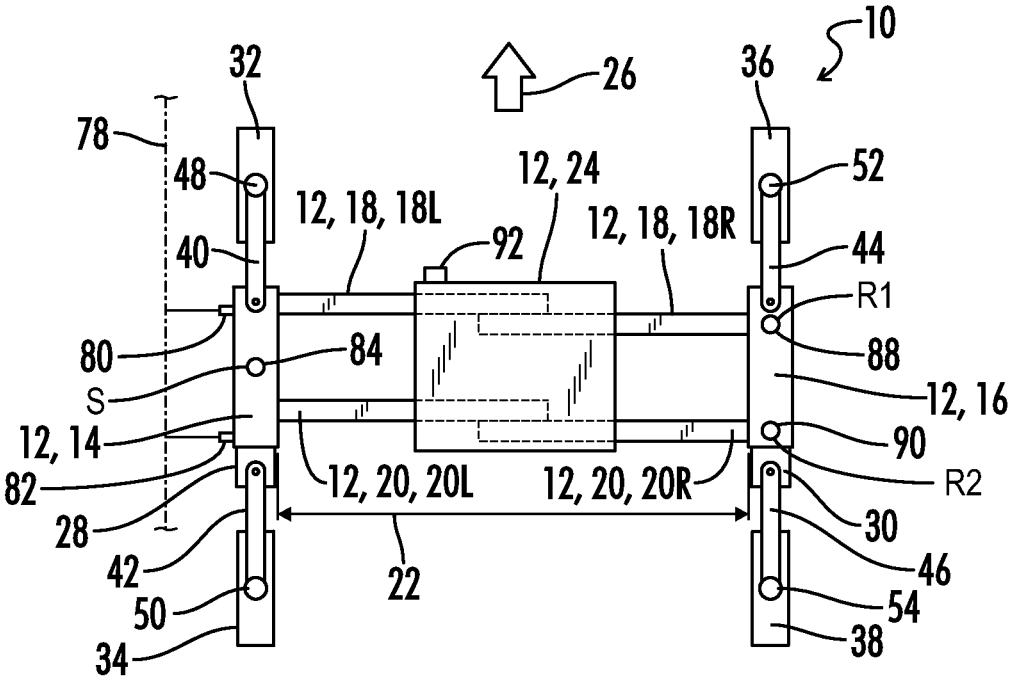
FIG. 1 is a schematic plan view of a slipform paving machine having an adjustable width and length.

FIG. 1 schematically illustrates a construction machine apparatus 10, which in the illustrated embodiment is a slipform paving apparatus 10. The apparatus 10 includes a machine frame 12. Machine frame 12 includes a reference side frame member 14 and a control side frame member 16. Front and rear transverse frame members 18 and 20 are connected to the side frame members 14 and 16. In the case illustrated, each of the front and rear transverse frame members 18 and 20 is a telescoping frame member which provides that a width 22 of the frame 12 between the side frame members is adjustable.

The machine frame 12 includes a center frame module 24. The front transverse frame member 18 comprises left and right front telescoping members 18L and 18R which are attached at their outer ends to their respective side frame members 14 and 16, and which are telescopingly received within the center frame module 24 as indicated by the dashed portions of the telescoping members 18L and 18R within the confines of the center module 24.

Similarly, the rear transverse frame member 20 includes male telescoping members 20L and 20R attached to their respective side frame members 14 and 16, and telescopingly received within the center module 24.

The side frame members 14 and 16 are also constructed so as to be adjustable in length parallel to a paving direction or operating direction indicated by the arrow 26. Thus the reference side or left side frame member 14 includes a rearwardly extendible reference side frame portion 28 and the right side or control side frame member 16 includes a rearwardly extendible control side frame member 30.

The machine 10 includes four ground engaging units 32, 34, 36 and 38 which in the illustrated embodiment are crawler track units. Wheels could also be used as ground engaging units. The machine 10 may have more than four ground engaging units.

The machine frame 12 includes four frame swing arms 40, 42, 44 and 46 which are pivotally attached to the machine frame and which carry the ground engaging units 32-38 at their outer ends.

Associated with each of the ground engaging units 32-38 are height adjustable supports or lifting columns. In the embodiment of FIG. 1 front and rear reference side height adjustable supports 48 and 50, respectively, support the reference side frame member 14 from the ground engaging units 32 and 34. Front and rear control side height adjustable supports 52 and 54 support the control side frame member 16 from the ground engaging units 36 and 38.

Figure 2:
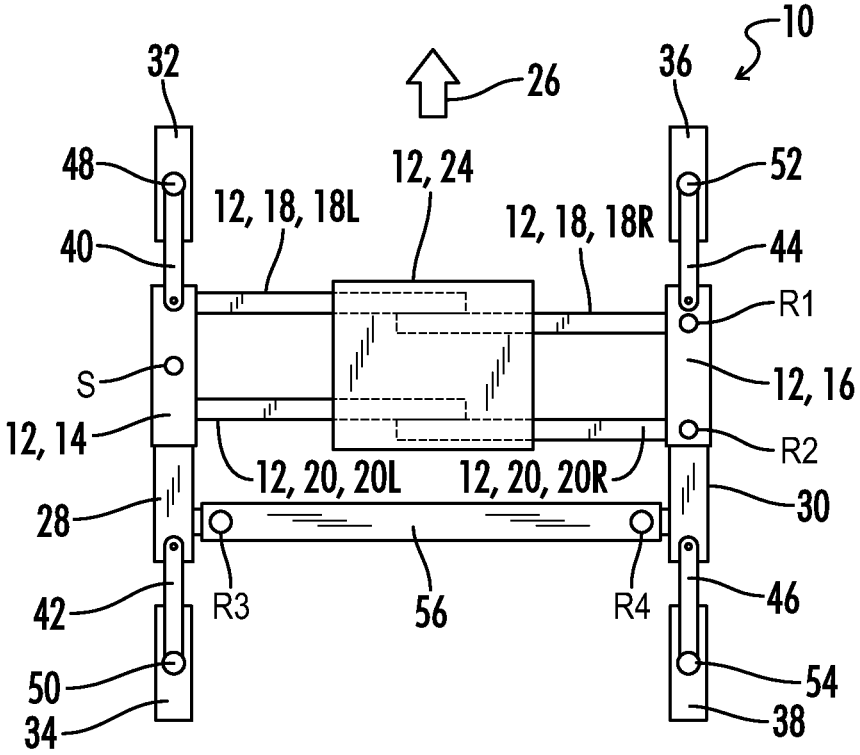
FIG. 2 is a schematic plan view of the construction machine of FIG. 1, showing the frame having been extended in length so as to accommodate an auxiliary component such as a dowel bar inserter carried on the rear of the machine frame.

In the schematic view of FIG. 2, the extendable frame members 28 and 30 have been extended relative to the side frame members 14 and 16 to allow for placement of an auxiliary component 56 on the rear of the slipform paving apparatus 10. The auxiliary component 56 may for example be a dowel bar inserter machine constructed to place dowel bars in the newly formed concrete structure.

Figure 3:
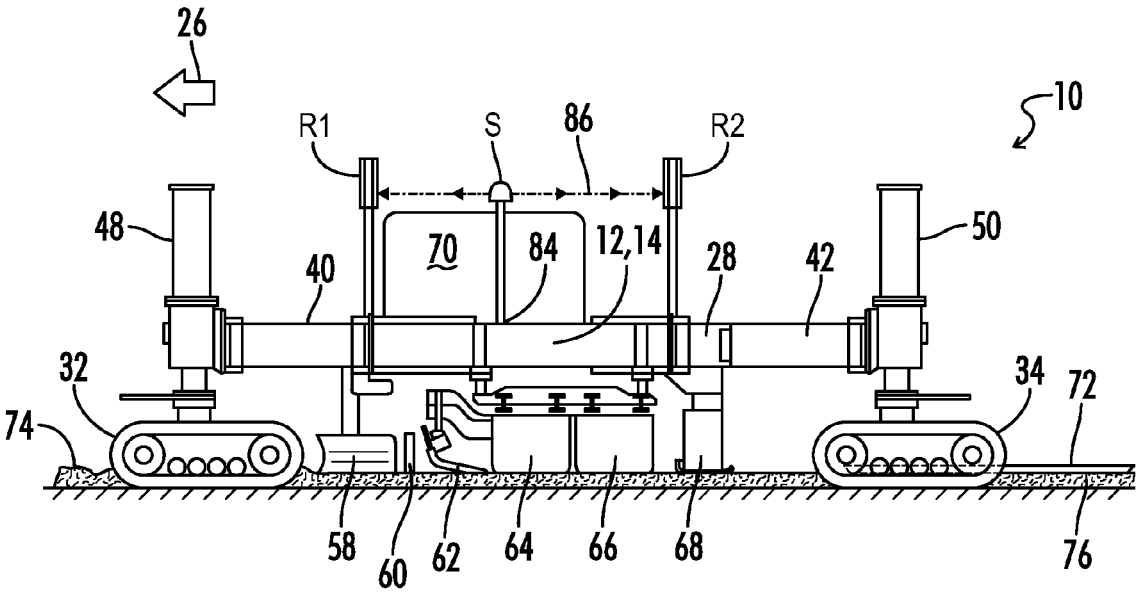
FIG. 3 is a left side elevation view of the slipform paving apparatus of FIG. 1.
Figure 4:
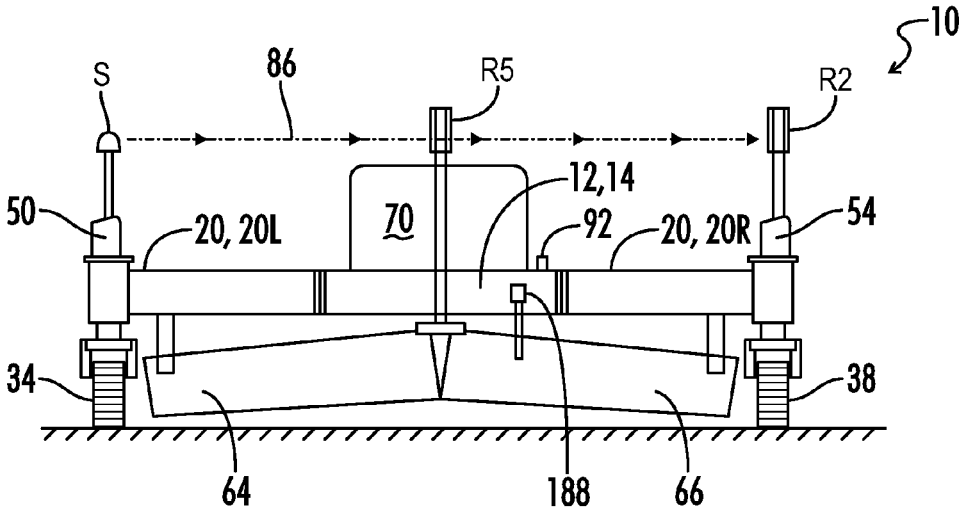
FIG. 4 is a rear elevation view of the slipform paving apparatus of FIG. 1.

Further features of the slipform paving machine 10 are seen in FIGS. 3 and 4. As seen in FIG. 3, a number of tools are carried by the machine frame 12, including a plow or concrete spreader 58, a front wall 60, a system of vibrators or concrete liquefying devices 62, first and second mold portions 64 and 66, a smoothing board 68 and a longitudinal smoothing board sometimes referred to as a super smoother 72.

Also carried on the main frame 12 is a tractor operations module 70 which may include a diesel engine for powering the various hydraulic and electrical systems, a control platform, an operator station and the like.

Figure 6:
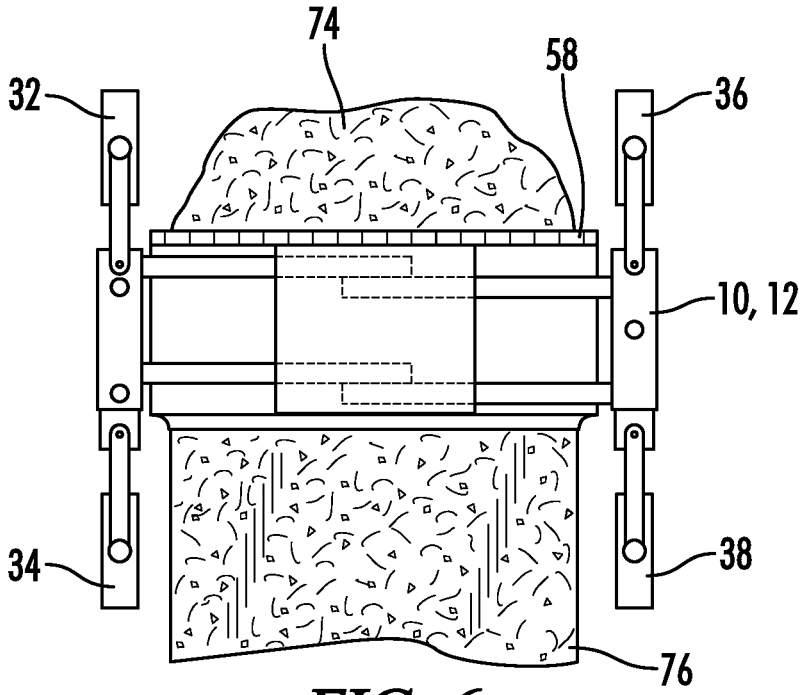
FIG. 6 is a schematic plan view showing the slipform paving apparatus of FIG. 1 forming a slipform concrete structure from a mass of concrete placed in front of the slipform paving apparatus.

As is seen in FIGS. 3 and 6, a mass of concrete 74 is placed in front of the slipform paving machine 10 and then the various components just described and particularly the mold 64, 66 forms the concrete into a molded concrete structure 76.

As is seen in FIG. 1, the slipform paving machine 10 may take a reference relative to the ground surface from a string line or guide line 78 which is fixed relative to the ground surface to provide a reference line paralleling the preferred path and elevation of the slipform paving machine 10. The machine 10 includes front and rear string line reference sensors 80 and 82 mounted on the reference side frame member 14 and configured to detect a height of the front and rear reference side height adjustable supports 48 and 50 relative to the external string line 78. It is further noted that a typical slipform paving machine 10 will be provided with string line reference sensors such as 80 and 82 on each side of the machine. Sometimes two string line references are utilized one on either side, and sometimes the string line reference may be located on the right hand side of the machine. The machine 10 may similarly take a reference directly from the ground surface, for example from a previously graded or previously paved ground surface.

A laser source S is fixed to the machine frame 12 at a first location 84 and is configured to generate a laser plane schematically illustrated at 86 in FIGS. 3 and 4. The laser source may for example be a Leica Rugby 600 series laser source available from Leica Geosystems AG and adequately fixed to the frame 12 and oriented so as to define the laser plane 86 parallel to the desired plane of the frame 12. By generating such a laser plane in a fixed orientation relative to the first location 84 on frame 12, a reference plane is provided independent of any ground reference system. This allows distortion of the frame 12 at other locations or displacement of auxiliary components to be measured and adjusted relative to the laser plane 86.

First and second laser sensors or receivers R1 and R2 are mounted on the machine frame 12 and arranged to intersect the laser plane 86 to detect a height of the frame 12 relative to the laser plane at second and third locations 88 and 90.

FIG. 1 shows a first possible arrangement of the laser source S and the laser receivers R1 and R2. In one embodiment, at least one of the laser plane source S, the first laser sensor R1 and the second laser sensor R2 should be mounted on each of the side frame members 14 and 16. In the embodiment illustrated in FIG. 1 the laser source S is located on the first side frame member 14 at a longitudinally central location, and the first and second laser sensors R1 and R2 are located on the control side frame member 16 longitudinally ahead of and behind the location of the laser source S, respectively.

In FIG. 2 where the auxiliary component 56 has been added, additional laser sensors or receivers R3 and R4 may be placed adjacent the outer ends of the auxiliary component 56.

Figure 5:
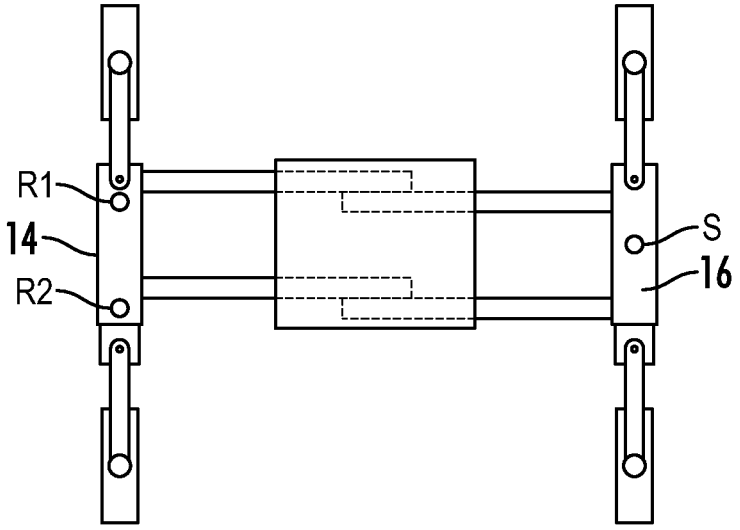
FIG. 5 is a view similar to FIG. 1 showing an alternative placement of the laser source and laser receivers.

FIG. 5 shows an alternative arrangement wherein the laser source S is placed on the control side frame member 16 and the laser sensors or receivers R1 and R2 are placed on the reference side frame member 14.

Additional laser sensors may be placed at any desired location on the machine frame, for example to measure flexing of the machine frame at various points, and additional height adjustable supports can be added so as to further control distortion of the machine frame.

A cross-slope sensor 92 is mounted on the machine frame 12 to measure a cross-slope of the machine frame 12 relative to gravity. The cross-slope sensor may be placed at any location on the frame. Additionally, multiple cross-slope sensors may be spaced across the width of the frame, and a mean value of all of the cross-slope sensors may be used for increased accuracy. The cross-slope sensor 92 may for example be a model 04-10-20015 sensor available from Moba Mobile Automation AG.

Figure 7:
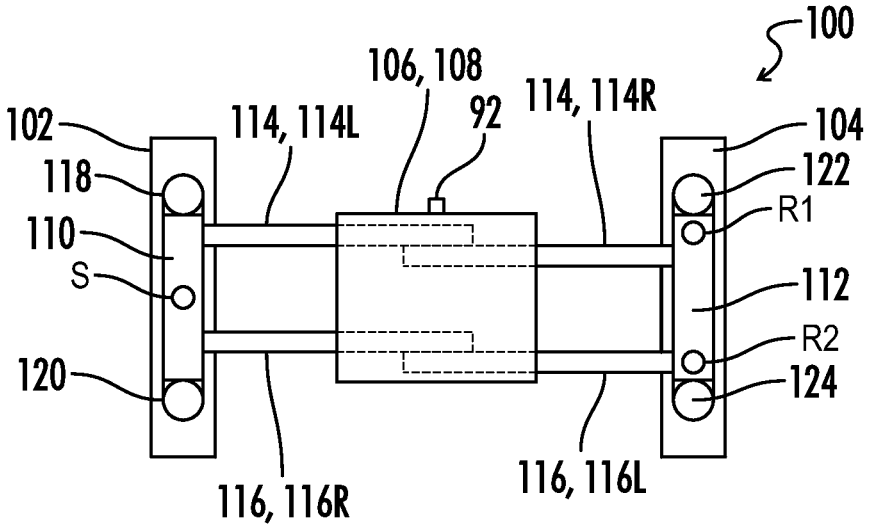
FIG. 7 is a schematic plan view of a slipform paving apparatus having only two ground engaging units.
Figure 8:
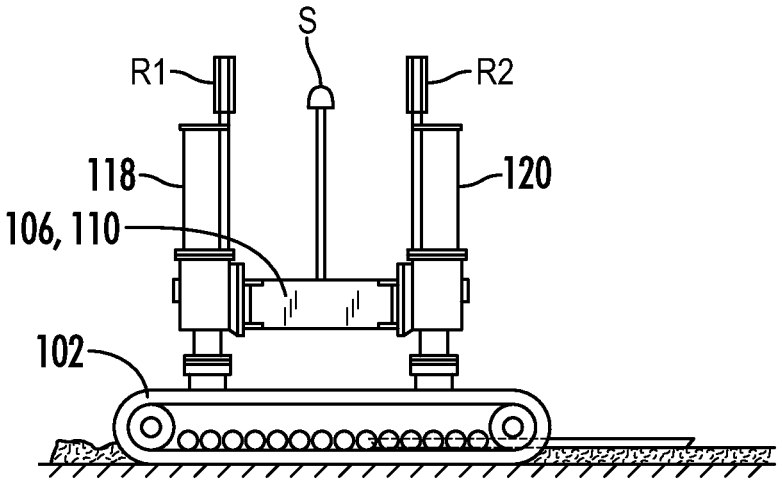
FIG. 8 is a left side elevation view of the slipform paving apparatus of FIG. 7.

FIGS. 7 and 8 illustrate a two track slipform paving machine 100. The slipform paving machine 100 has a reference side ground engaging unit or crawler track 102 and a control side ground engaging unit or crawler track 104. A machine frame 106 includes a frame center module 108 and left and right side frame members 110 and 112. The machine frame includes a front transverse frame member 114 made up of left and right extendible members 114L and 114R received in the center module 108. Similarly left and right rear transverse frame members 116L and 116R are provided. In the case of the two track machine of FIG. 7, the frame 106 is adjustable widthwise but is not adjustable in length. The machine frame 106 is supported from the left and right ground engaging units 102 and 104 by a left front height adjustable support 118, a left rear height adjustable support 120, a right front height adjustable support 122 and a right rear height adjustable support 124.

Figure 10:
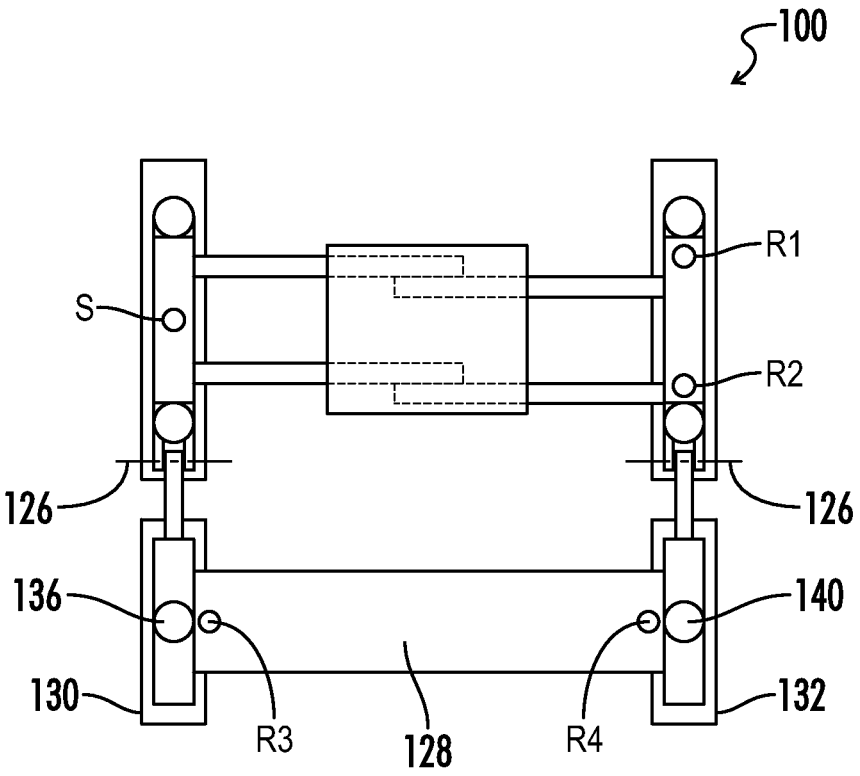
FIG. 10 is a schematic plan view showing the slipform paving apparatus of FIG. 7 towing a separately supported auxiliary component such as a dowel bar inserter.

In a third arrangement as shown in FIG. 10, the two track paving machine 100 of FIG. 7 may have attached thereto at an articulated connection 126 an auxiliary component 128, such as for example a dowel bar inserter, supported by separate ground engaging units 130 and 132. The auxiliary component 128 may be supported from the ground engaging units 130 and 132 by height adjustable support members 136 and 140. Additional laser receivers R3 and R4 may be located on the auxiliary unit 128 as shown.

Figure 9:
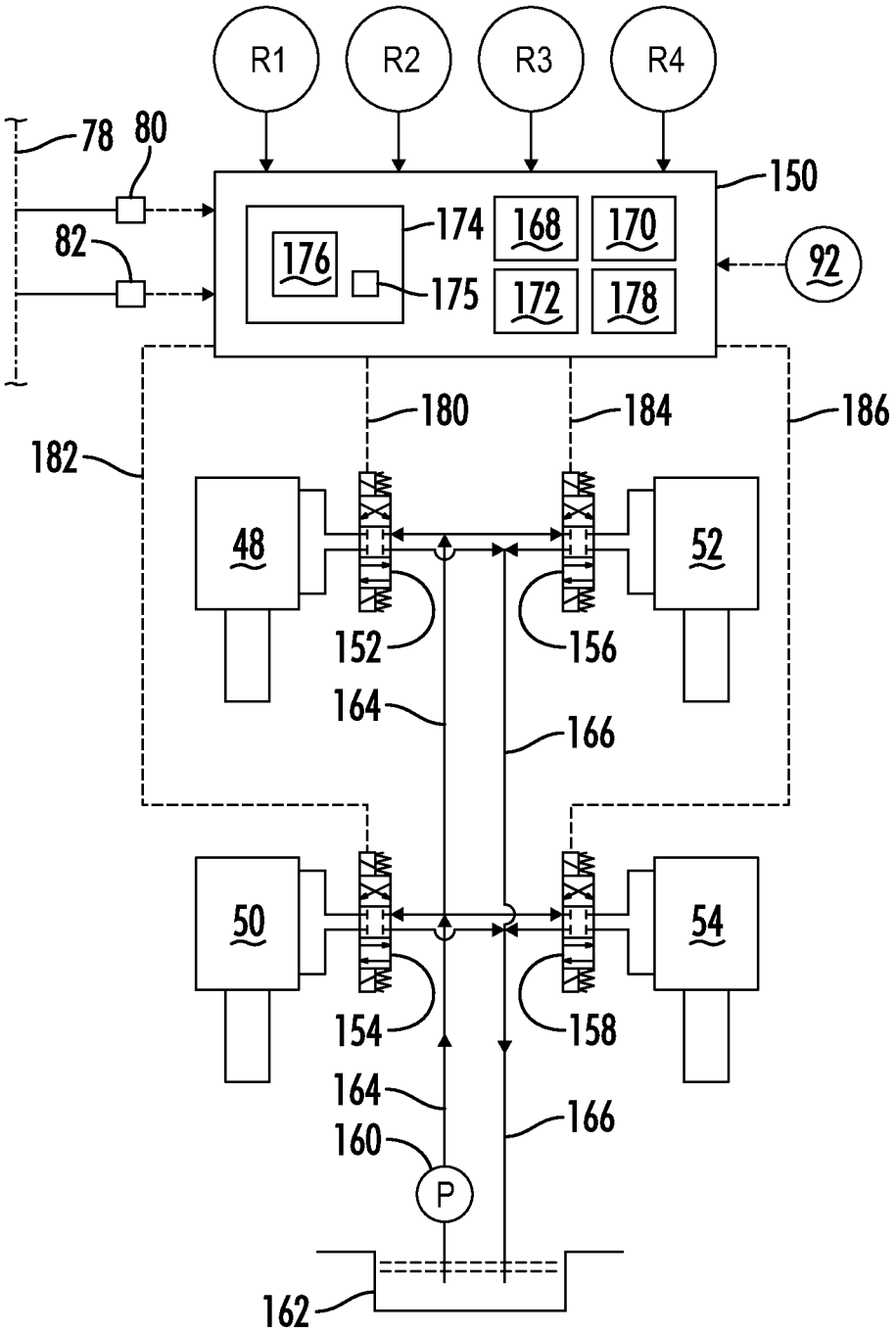
FIG. 9 is a schematic drawing of the control system for the apparatus of either FIG. 1 or FIG. 7.

With any of the construction machine embodiments of FIG. 1, 7 or 10, the construction machine includes a controller 150 schematically illustrated in FIG. 9. The controller 150 is configured to receive input signals from the various laser sensors R1, R2, R3 and R4 and from the cross-slope sensor 92 and to control height adjustment of the various height adjustable supports such as 48, 50, 52 and 54 illustrated in FIG. 9. The control system 150 further takes reference inputs from the string line reference sensors 80 and 82.

Each of the height adjustable supports 48-54 comprises a two way hydraulic piston and cylinder which can be extended or retracted based upon the supply of hydraulic fluid under pressure to either side of the hydraulic piston.

Associated with each of the height adjustable supports are hydraulic control valves 152, 154, 156 and 158. A hydraulic pump 160 takes hydraulic fluid from the fluid supply 162 and delivers it to hydraulic supply line 164. Fluid returned from the hydraulic rams or height adjustable supports 48-54 returns to fluid reservoir 162 through a hydraulic fluid return line 166.

Controller 150 includes a processor 168, a computer readable memory medium 170, a data base 172 and an input/output module or control panel 174 having a display 176. An input/output device 175, such as a keyboard or other user interface, is provided so that the human operator main input instructions to the controller.

The term "computer-readable memory medium" as used herein may refer to any non-transitory medium 170 alone or as one of a plurality of non-transitory memory media 170 within which is embodied a computer program product 178 that includes processor-executable software, instructions or program modules which upon execution may provide data or otherwise cause a computer system to implement subject matter or otherwise operate in a specific manner as further defined herein. It may further be understood that more than one type of memory media may be used in combination to conduct processor-executable software, instructions or program modules from a first memory medium upon which the software, instructions or program modules initially reside to a processor for execution.

"Memory media" as generally used herein may further include without limitation transmission media and/or storage media. "Storage media" may refer in an equivalent manner to volatile and non-volatile, removable and non-removable media, including at least dynamic memory, application specific integrated circuits (ASIC), chip memory devices, optical or magnetic disk memory devices, flash memory devices, or any other medium which may be used to stored data in a processor-accessible manner, and may unless otherwise stated either reside on a single computing platform or be distributed across a plurality of such platforms. "Transmission media" may include any tangible media effective to permit processor-executable software, instructions or program modules residing on the media to be read and executed by a processor, including without limitation wire, cable, fiber-optic and wireless media such as is known in the art.

The term "processor" as used herein may refer to at least general-purpose or specific-purpose processing devices and/or logic as may be understood by one of skill in the art, including but not limited to single- or multithreading processors, central processors, parent processors, graphical processors, media processors, and the like.

The controller 150 receives input data from laser sensors or receivers R1, R2, R3 and R4, the cross-slope sensor 92, and the string line reference sensors 80 and 82. The controller 150 controls the operation of the height adjustable supports 48, 50, 52 and 54 via control signals sent over control lines 180, 182, 184 and 186 to the hydraulic valves 152, 154, 156 and 158, respectively.

Methods of Operation

In each of the embodiments illustrated the machine frame 12 or 106 is supported by four height adjustable supports. The machine frame may be thought of as a generally planar structural member. It will be appreciated, however, that only three points of support are required to define a plane. If there is a fourth point of support, that fourth point of support may be in the plane defined by the other three points of support, or it may be offset from that plane in which case the generally planar support frame is distorted. A planar structure supported by more than three points of support may be generally described as an over-determined structure, in that the fourth point of support may in fact cause distortion of the generally planar structural shape.

Thus with each of the embodiments illustrated, depending upon the ground terrain encountered by the various ground engaging units adjacent the four height adjustable supports, it is possible that distortion may be imparted to the frame 12.

The control system 150 is configured to control this distortion. By control of the distortion it is meant to include both elimination of the distortion, and control of a desired or permissible extent of distortion. This control of frame distortion is provided by adjusting one or more of the height adjustable supports.

Referring now to the arrangement of FIG. 1, the laser source S mounted on reference side frame member 14 generates a laser reference plane 86 as schematically illustrated in FIGS. 3 and 4. That laser reference plane 86 is fixed relative to the first location 84 on the machine frame 12. Preferably the laser source S is mounted such that the laser plane 86 is parallel to the length front to rear of the reference side frame member 14. In this manner if other portions of the frame are determined to be parallel to the laser plane 86 they will also be in the same plane as the reference side frame member 14.

A height of the laser reference plane 86 relative to two other locations 88 and 90 on the control side frame member 16 is detected by the first and second laser sensors or receivers R1 and R2 which intersect the laser plane 86. Signals from the sensors R1 and R2 are received by the controller 150.

Simultaneously, the controller 150 is receiving input signals from string line reference sensors 80 and 82. The controller 150 is also receiving a cross-slope signal from cross-slope sensor 92.

Assuming for example that it is desired to keep the machine frame 12 perfectly horizontal and to fix the height of that plane with reference to the string line 78, the controller 150 will operate as follows. Input signals from the string line reference sensors 80 and 82 are received by controller 150 and the height adjustable supports 48 and 50 are adjusted to maintain the reference side frame member 14 parallel and with the desired elevation with respect to the string line 78.

Input signals from the laser receivers R1 and R2 are received by controller 150 and the controller 150 may then send appropriate signals to control side height adjustable supports 52 and/or 54 to maintain the control side frame member 16 parallel to laser plane 86 and thus to the reference side frame member 14. Finally, a cross-slope signal is received from cross-slope sensor 92 and the controller 150 may control one or both of the control side height adjustable supports 52 and 54 to set the cross-slope at zero so that the entire frame 12 is non-distorted and is perfectly horizontal. It will be recognized, of course, that the control signals from controller 150 to the control side height adjustable supports 52 and 54 must be coordinated in order to adjust for inputs from both the laser sensors R1 and R2 and the cross-slope sensor 92.

Preferably, the controller 150 analyzes the combined inputs and adjusts the height of only one of the front and rear control side height adjustable supports 52 and 54 in order to control distortion of the machine frame 12, and controls the height of the other of the control side height adjustable supports 52 and 54 to control the cross-slope of the machine frame 12.

It is further preferred that the cross-slope of the machine frame 12 be controlled by height adjustment of the rear height adjustable control side support 54, because the most critical dimension of control for the slipform paver 10 is to control the rear of the machine frame 12 where the mold 64, 66 and other shape forming auxiliary components are located.

Thus, in this preferred mode of operation the controller 150 sends a first control signal to the rear control side height adjustable support 54 to control the cross-slope of the machine frame, and a second control signal to the front control side height adjustable support 52 to control any distortion in the frame 12 relative to a plane defined by the three height adjustable supports 48, 50 and 54.

Additionally, it is noted that in the more general case it may be desired to maintain an actual cross-slope so that the plane of the machine frame 12 is not exactly horizontal. This is accomplished by inputting to the controller 150 a value for the desired cross-slope, and then controlling the cross-slope of the machine frame 12 via control of the rear height adjustable support 54 so as to result in a cross-slope at the desired set point which was input.

The human operator of the slipform paver 10 may input such desired set points via the input-output device 175 of controller 150.

Similarly, it is noted that in the more general case it may be desired that there actually be some distortion in the machine frame 12. For example, in the situation where the slipform paver machine 10 is entering a cambered portion of a surface which is to be paved, such as for example in a curve of a highway, it may be desired to transition from one cross-slope value to another cross-slope value to provide a banked curve. Such a transition can be in part accomplished by actually inducing a distortion in the machine frame 12, to the extent that the structural construction of machine frame 12 is capable of distortion. Again, a set point for such desired frame distortion may be input to the controller 150 and the desired distortion may be created by adjusting the height of the control side forward height adjustable support 52.

The distortion of the machine frame 12 may be characterized as a difference in longitudinal inclination between the reference side frame member 14 and the control side frame member 16. It is recalled that the longitudinal inclination of the reference side frame member 14 is controlled in response to the reference line 78 and the string line input sensors 80 and 82. Thus any distortion of the frame 12 will result in a longitudinal inclination of the control side frame member 16 which is not parallel to the reference side frame member 14. Again, that distortion may be characterized as a change in relative longitudinal inclination between the side frame members 14 and 16.

Referring now to the embodiment of FIG. 10, it is noted that in addition to using the laser reference plane 86 as a reference plane for controlling distortion of the machine frame 12, the laser reference plane 86 provides a reference plane by which other components of the slipform paving machine which are not fixedly attached to the machine frame 12 may be controlled. For example in FIG. 10, the auxiliary component 128 is supported from the separate ground engaging units 130 and 132 by auxiliary height adjustable supports 136 and 140. Both the elevation and cross-slope of the auxiliary component 128 relative to the reference plane 86 may be controlled by the controller 150 in a manner similar to that described with regard to FIG. 9. It will be understood that the additional sensors such as laser receivers R3 and R4 provide inputs to the controller 150 and that additional outputs from the controller 150 will control hydraulic valves to adjust the auxiliary height adjustable supports 136 and 140 in a manner similar to that described with regard to FIG. 9 for the height adjustable supports 48-54. The auxiliary component 128 may for example be a dowel bar inserter or a texturing and curing machine.

It will be appreciated that the laser receivers do not have to be located directly above the height adjustable support which is closest to the respective laser receiver. However, each laser receiver will typically provide input that results in adjustment of the height adjustable support closest to that laser receiver. The laser receivers additionally could be placed on the swing legs or on top of the outer housing of the height adjustable supports. Furthermore, the laser receivers could be placed on the cross beams, preferably at locations relatively close to the side frame members of the cross frame members Still other aspects of the slipform paving machine 10 may be controlled with reference to the laser reference plane 86. For example, as schematically illustrated in FIG. 4, the mold members 64 and 66 may be supported in a pivotable manner relative to each other so as to form a crown in the paved surface. The pivotal connection between the mold components can be described as an articulated connection to the machine frame 12. The mold members 64 and 66, which may generally be referred to as an auxiliary component of the slipform paver machine 10, may have a laser sensor R5 associated therewith which is representative of the height of the crown of the mold members 64 and 66. The controller 150, in response to a signal received from sensor R5 may control an actuator 188 for adjusting the crown of the mold members 64 and 66.

Thus it is seen that the apparatus and methods of the present invention readily achieve the ends and advantages mentioned as well as those inherent therein. While certain preferred embodiments of the invention have been illustrated and described for purposes of the present disclosure, numerous changes in the arrangement and construction of parts and steps may be made by those skilled in the art, which changes are encompassed with the scope and spirit of the present invention as defined by the appended claims.

What is claimed is:

1. A construction machine apparatus, comprising:

a machine frame:

at least two self-propelling ground engaging units;

a plurality of height adjustable supports, at least three of the height adjustable supports being arranged to support the machine frame from the ground engaging units;

a laser plane source mounted on the machine frame at a first location and arranged to generate a laser plane;

first and second laser sensors mounted on the construction machine at at least two other locations and arranged to intersect the laser plane to detect a height of the at least two other locations relative to the laser plane; and a controller configured to receive input signals from the first and second laser sensors and to control height adjustment of at least one of the at least two other locations.

2. The apparatus of claim 1, wherein:

the at least two other locations are on the machine frame so that the first and second laser sensors detect distortion of the machine frame; and the controller is configured to control the distortion of the machine frame.

3. The apparatus of claim 2, wherein:

the machine frame includes a reference side frame member, a control side frame member, and at least one transverse frame member connected to the side frame members;

at least one of the laser plane source, the first laser sensor and the second laser sensor are mounted on each of the side frame members;

the at least two self-propelling ground engaging units include at least one reference side ground engaging unit and at least one control side ground engaging unit; and the at least three height adjustable supports arranged to support the machine frame include:

front and rear reference side height adjustable supports supporting the reference side frame member from the at least one reference side ground engaging unit; and front and rear control side height adjustable supports supporting the control side frame member from the at least one control side ground engaging unit.

4. The apparatus of claim 3, further comprising:

a cross-slope sensor mounted on the machine frame and arranged to detect a cross-slope angle of the machine frame; and wherein the controller is configured to receive input signals from the cross-slope sensor and to control the cross-slope angle of the frame in response to the cross-slope sensor.

5. The apparatus of claim 4, wherein:

the controller is configured to generate a longitudinal inclination adjustment signal to control a longitudinal inclination of the control side frame member relative to the laser plane.

6. The apparatus of claim 5, wherein:

the control side frame member is maintained longitudinally parallel to the reference side frame member.

7. The apparatus of claim 5, wherein:

the controller is configured to generate a cross-slope adjustment signal to control the cross-slope angle relative to gravity.

8. The apparatus of claim 7, wherein:

the controller is configured such that the cross-slope adjustment signal directs a height adjustment of the rear control side height adjustable support; and the controller is configured such that the longitudinal inclination adjustment signal directs a height adjustment of the front control side height adjustable support.

9. The apparatus of claim 4, wherein:

the construction machine apparatus is a slipform paver machine and the at least one transverse frame member is adjustable to adjust a width of the machine frame.

10. The apparatus of claim 4, wherein:

the laser source is mounted on one of the side frame members, and the first and second laser sensors are longitudinally spaced on the other of the side frame members.

11. The apparatus of claim 4, further comprising:

front and rear string line reference sensors mounted on the reference side frame member and configured to detect a height of the front and rear reference side height adjustable supports relative to an external string line; and wherein the controller is configured to receive input signals from the front and rear string line reference sensors, and to control height adjustment of the front and rear reference side height adjustable supports in response to the front and rear string line reference sensors, respectively.

12. The apparatus of claim 1, wherein:

the at least two other locations are on the machine frame so that the first and second laser sensors detect distortion of the machine frame;

the at least three height adjustable supports arranged to support the machine frame from the ground engaging units includes at least four height adjustable supports supporting the machine frame from the ground engaging units so that a planar shape of the machine frame is over-determined; and the controller is configured to control the distortion of the machine frame by adjusting at least one of the at least four height adjustable supports relative to the others of the at least four height adjustable supports.

13. The apparatus of claim 1, further comprising:

an auxiliary component having an articulated connection to the machine frame; and wherein the at least two other locations are locations on the auxiliary component.

14. The apparatus of claim 13, wherein:

the plurality of height adjustable supports includes at least two auxiliary height adjustable supports arranged to support the auxiliary component; and the controller is configured to adjust a cross-slope of the auxiliary component transverse to an operating direction of the construction machine.

15. The apparatus of claim 13, wherein:

the plurality of height adjustable supports includes at least two auxiliary height adjustable supports arranged to support the auxiliary component; and the controller is configured to adjust both of the at least two auxiliary height adjustable supports to adjust a height of both of the at least two other locations on the auxiliary component relative to the reference plane.

* * * * *